US010525608B1

(12) United States Patent
Sagorski

(10) Patent No.: US 10,525,608 B1
(45) Date of Patent: Jan. 7, 2020

(54) FOOD CUTTING GUIDE

(71) Applicant: Francis A Sagorski, Traverse City, MI (US)

(72) Inventor: Francis A Sagorski, Traverse City, MI (US)

( * ) Notice: Subject to any disclaimer, the term of this patent is extended or adjusted under 35 U.S.C. 154(b) by 158 days.

(21) Appl. No.: 15/957,964

(22) Filed: Apr. 20, 2018

(51) Int. Cl.
*B26B 29/06* (2006.01)

(52) U.S. Cl.
CPC ..... *B26B 29/063* (2013.01)

(58) Field of Classification Search
CPC . B26B 29/063; B26B 29/06; B26B 2029/066; B26B 3/04
USPC ..... 33/524
See application file for complete search history.

(56) References Cited

U.S. PATENT DOCUMENTS 367,689 A * 8/1887 Wilson ..... B26D 7/30 83/77
1,072,450 A 9/1913 Hamblin
1,124,418 A 1/1915 Goodfellow
1,131,333 A 3/1915 Coon
1,462,717 A 7/1923 Maus
1,703,154 A 2/1929 Lanzkron
1,764,235 A * 6/1930 Wilmking ..... B26B 29/063 83/762
1,867,993 A 7/1932 Tuttle
2,263,965 A 11/1941 Fiori
2,398,192 A 4/1946 Scheminger, Jr.
2,485,035 A 10/1949 Chensky
2,502,739 A 4/1950 Nohrden
3,058,503 A 10/1962 Perakis
4,056,026 A 11/1977 Panaritis et al.
4,399,989 A 8/1983 Baillie
4,599,928 A * 7/1986 Oker ..... B26D 1/553 83/581.1
4,890,525 A 1/1990 Bilbao
4,964,323 A 10/1990 Fortney
5,115,704 A 5/1992 Hyman
5,287,784 A 2/1994 Brockett
5,386,755 A 2/1995 Schneider et al.
5,499,578 A 3/1996 Payne
5,598,759 A 2/1997 Sie et al.
5,653,154 A * 8/1997 Liu ..... B26B 29/063 83/468.5
5,709,423 A 1/1998 Romero
5,907,989 A 6/1999 Sie et al.
7,007,583 B1 3/2006 Fiola
7,547,006 B1 6/2009 Lockwood
8,241,688 B2 8/2012 Aguirre
8,448,552 B2 5/2013 Hoffman
(Continued)

*Primary Examiner* — Yaritza Guadalupe-McCall
(74) *Attorney, Agent, or Firm* — Peter Loffler

(57) ABSTRACT

A food cutting guide for safely holding a food item and allowing for essentially uniform thickness cuts to be made through the food item has a base with a pair of opposing jaws pivotally attached to the base. Each jaw has a series of spaced apart teeth such that the jaws articulate between a closed position wherein the teeth of each jaw intermesh with one another and an open position wherein the teeth do not so intermesh. A spring mechanism holds the jaws in a normally closed position while an actuation trigger articulates the jaws to the open position against the bias of the spring mechanism. A guard plate is located at an end of the pair of jaws to protect a user's hand from errant knife travel.

9 Claims, 6 Drawing Sheets

(56) References Cited

U.S. PATENT DOCUMENTS

| | | | |
|---|---|---|---|
| 9,636,831 | B1 | 5/2017 | Furia |
| 2004/0144227 | A1 | 7/2004 | White |

* cited by examiner

FOOD CUTTING GUIDE

BACKGROUND OF THE INVENTION

1. Field of the Invention

The present invention relates to a device that grips a vegetable or other food product and provides guides that allow a user to make cuts of uniform thickness into the vegetable or other food product, without exposing the user's fingers to the knife blade during the cutting process.

2. Background of the Prior Art

Cutting vegetables is a regular chore in many households. From appetizers, to salads, to soups, to main course side dishes, vegetables are a staple at meal time. While some people are adept at using a knife and being able to cut the vegetables quickly and of generally uniform thickness, others are not very good at vegetable cutting, resulting in vegetables of varying thickness, resulting in uneven cooking times. Finger cuts can also occur as the knife slips off the food product and strikes the gripping hand. The lack of knife skills can be due to either inexperience or to lack of dexterity in the fingers from a condition such as arthritis or the natural effects of aging.

To address this problem, various devices have been proposed that assist in the food cutting process so as to allow a person to cut food products of nearly uniform thickness. These devices, which come in a wide variety of architectures and work with varying degrees of effectiveness, suffer from certain drawbacks. Some prior art devices are complex in design and operation, making such devices expensive to produce and difficult and often frustrating to use. Some prior art devices, while allowing generally uniform thickness cuts to be made, do not grip the food product, requiring the user to grip the product during the cutting of the food product and thus exposing the user to potential injury from a wayward knife.

What is needed is a device that can quickly and easily hold and grip a vegetable or other food product and allow a user to make uniform cuts through the food product without exposing his or her hands to potential injury from the knife performing the cut. Such a device must be of relatively simple design and must be relatively easy to use.

SUMMARY OF THE INVENTION

The food cutting guide of the present invention addresses the aforementioned needs in the art by providing a device that holds a food product, such as a vegetable, and firmly grips the food product so held. A user is able to make essentially uniform thickness cuts through the food product without exposing his or her fingers to potential knife cuts as would otherwise be the case if the user is required to grip the food product with his or her hand. The food cutting guide is of relatively simple design and construction, being produced using standard manufacturing techniques, so that the device is relatively inexpensive to produce and thus is economically attractive to potential users of this type of product. The food cutting guide is very quick and easy to use.

The food cutting guide of the present invention is comprised of a base. A pair of opposing jaws is provided such that each jaw has a series of spaced apart teeth. The jaws articulate between a closed position wherein the teeth of one of the jaws intermesh with the teeth of the other jaw, and an open position wherein the teeth of each jaw are not intermeshed and are spaced apart from one another. A spring mechanism is attached to each jaw such that the spring mechanism spring biases each jaw into the closed position. An actuator trigger is pivotally attached to the base such that when the jaws are in the closed position, the actuator trigger engages each jaw and moves the jaw into the open position, overcoming the spring bias of the spring mechanism. A guard plate is attached to base and is positioned at the end of jaw pair. A stop pin is attached to the guide plate and is slidable between a stop position wherein the stop pin is within a travel path of one of the jaws (preventing that jaw from opening) and an unstop position wherein the stop pin is not in the travel path of the jaw (allowing the jaw to open). The stop pin is spring biased between the stop and the unstop position. Each jaw is comprised of a jaw bar that is axially attached to a pair of opposing posts such that the teeth of the jaw extend upwardly from the jaw bar. A pair of actuator bars is provided such that one bar each is attached to a respective one of the jaw bars such that when the actuator trigger is pivoted upwardly away from the base, the actuator trigger engages each actuator bar causing each jaw to rotate to the open position. Each spring mechanism comprises a jaw spring that has a first end attached to a respective one of the jaw bars and an opposing second end attached to one of the posts of that jaw bar. Each of the teeth of a jaw is curved toward the opposing jaw.

BRIEF DESCRIPTION OF THE DRAWINGS

Similar reference numerals refer to similar parts throughout the several views of the to drawings.

DESCRIPTION OF THE PREFERRED EMBODIMENT

Figure 1:
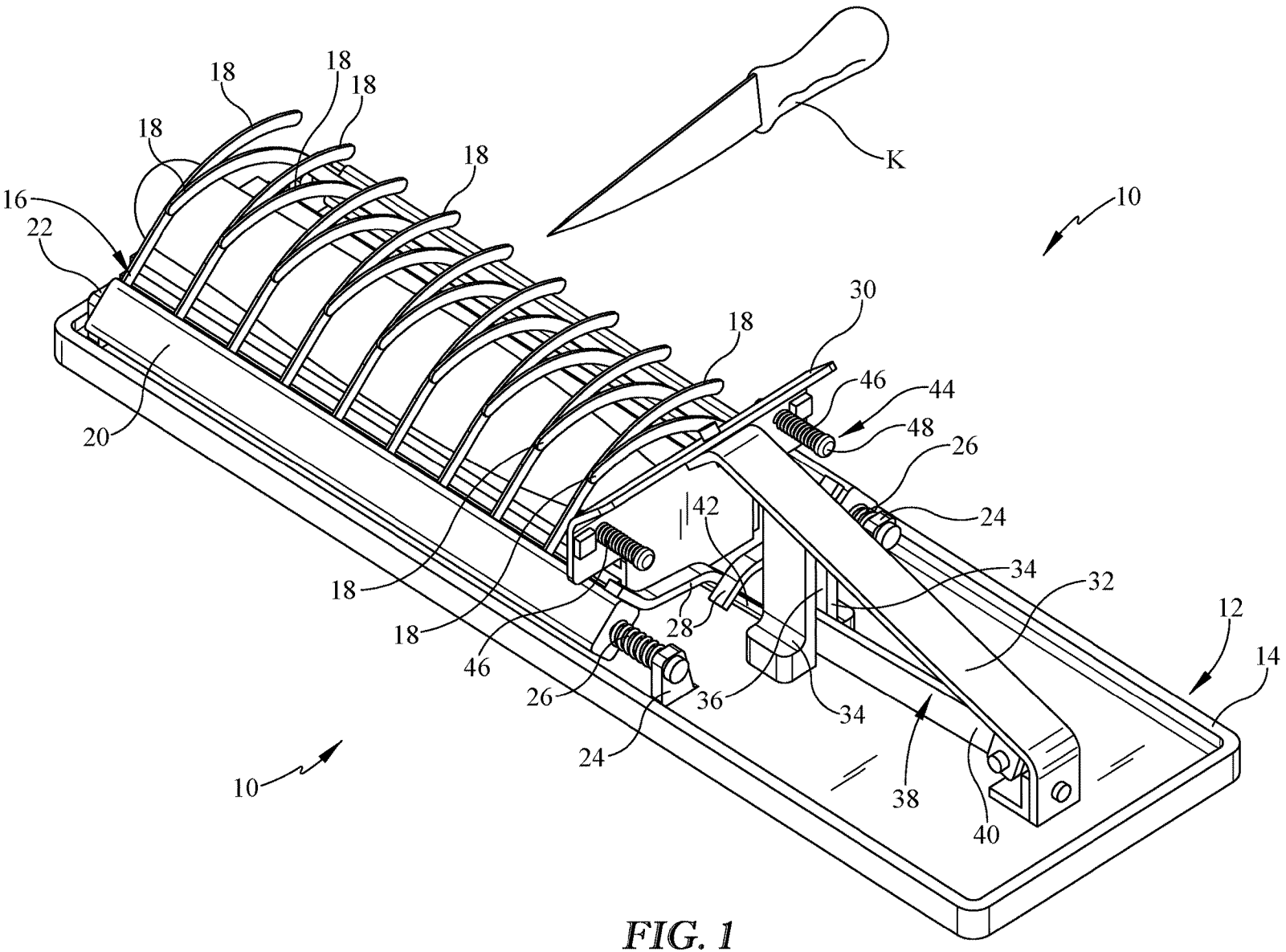
FIG. 1 is perspective view of the food cutting guide of the present invention in a normally relaxed closed gripping position.
Figure 2:
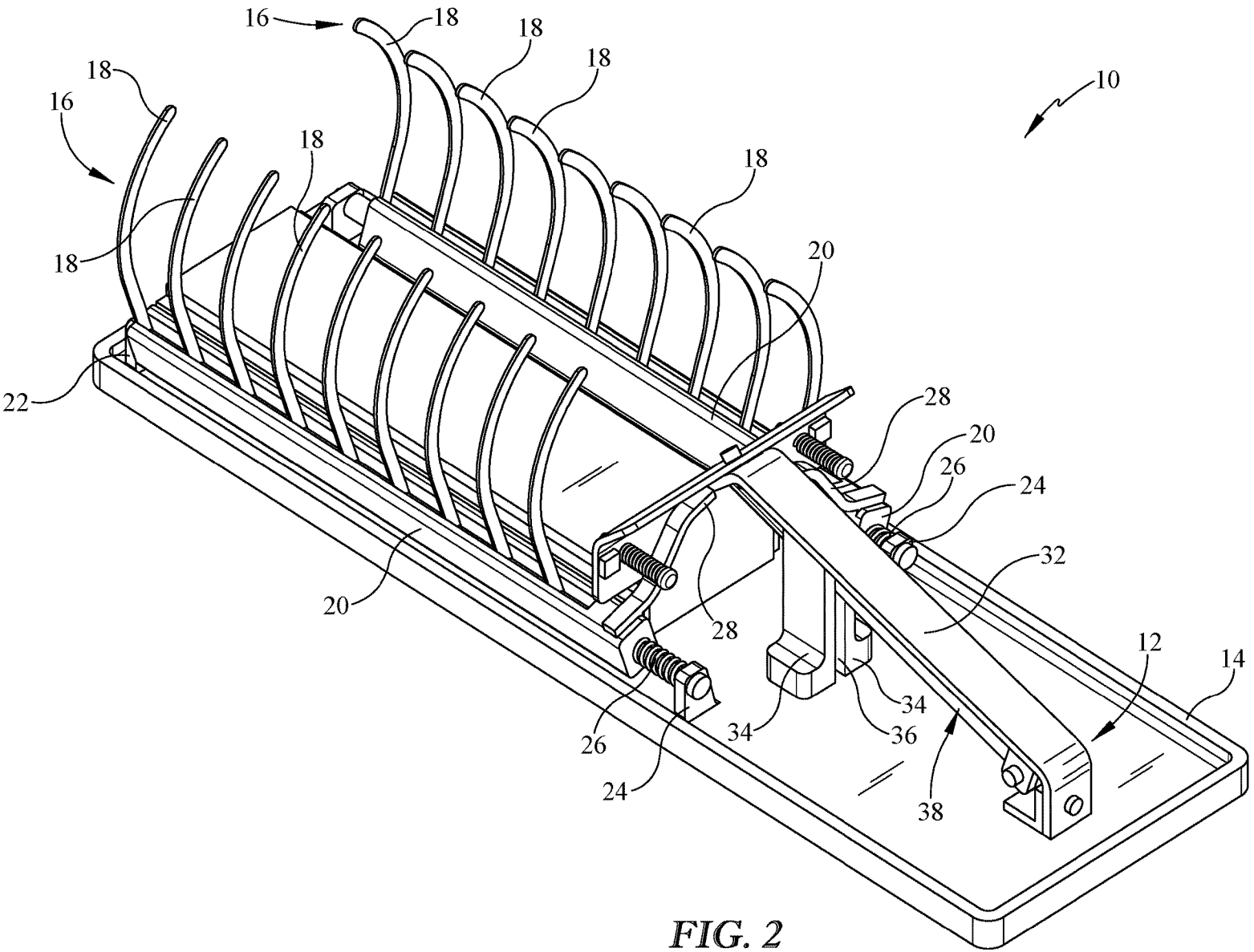
FIG. 2 is a perspective view of the food cutting guide in an open position.
Figure 3:
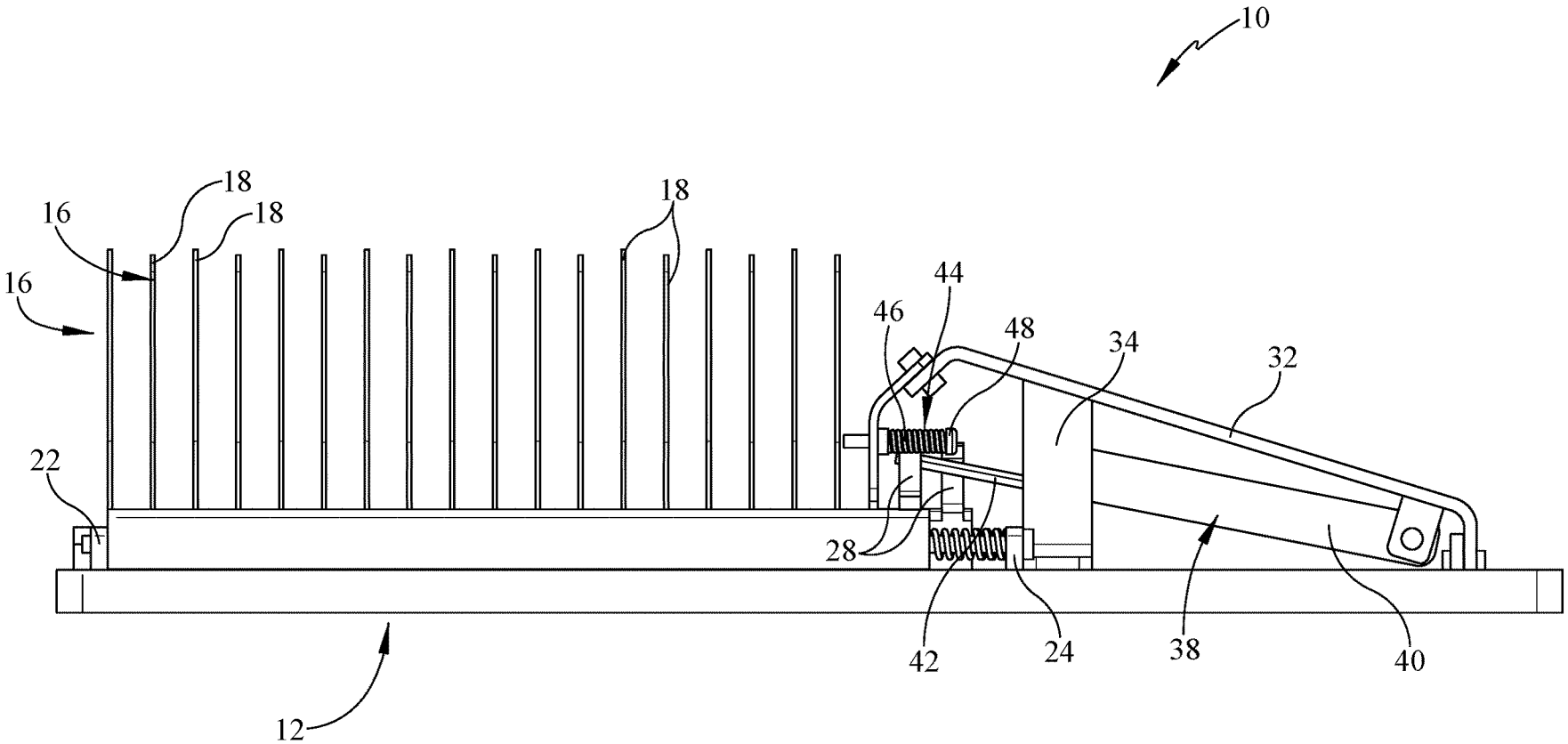
FIG. 3 is a side view of the food cutting guide.
Figure 4:
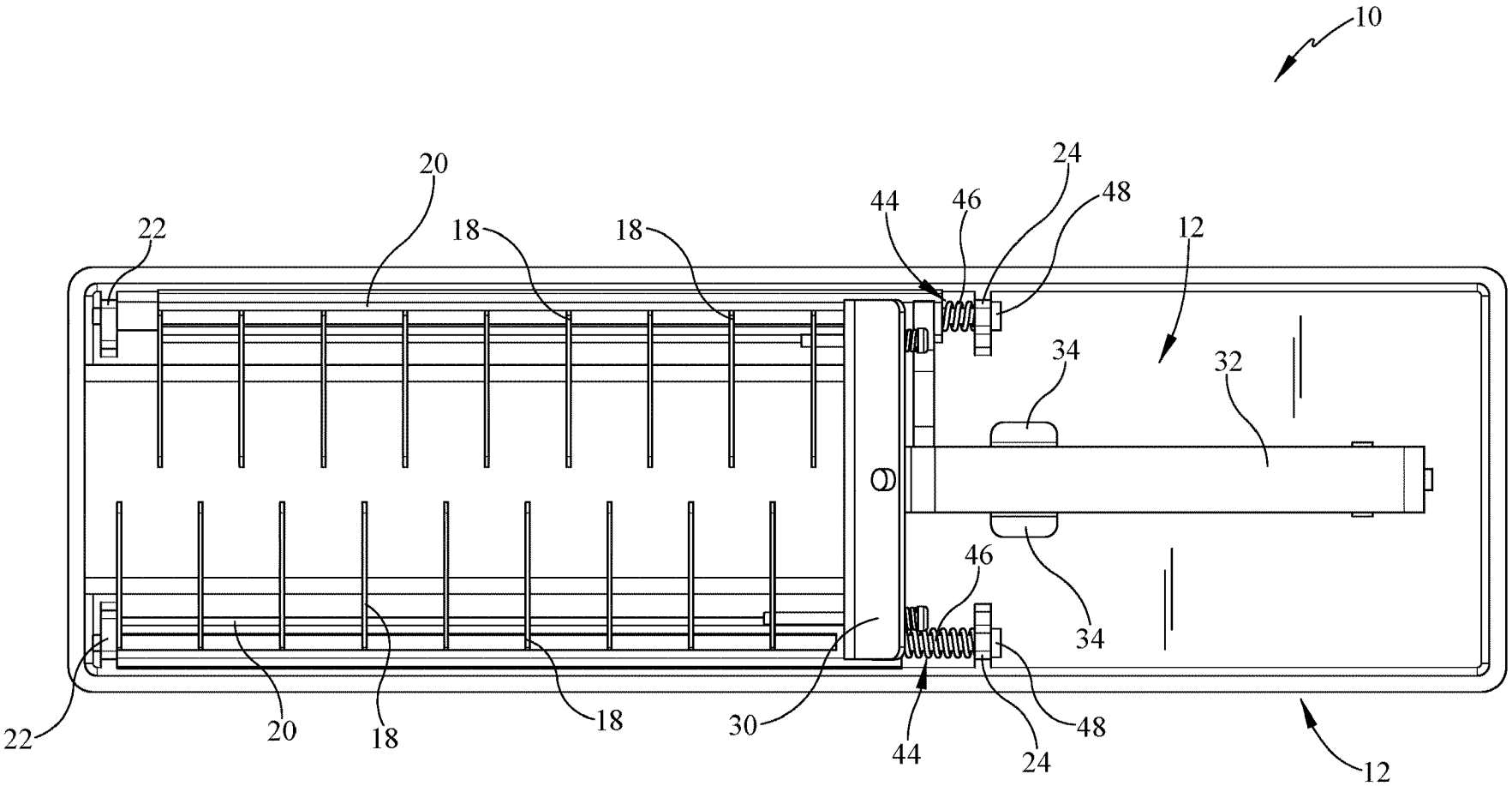
FIG. 4 is a top view of the food cutting guide.
Figure 5:
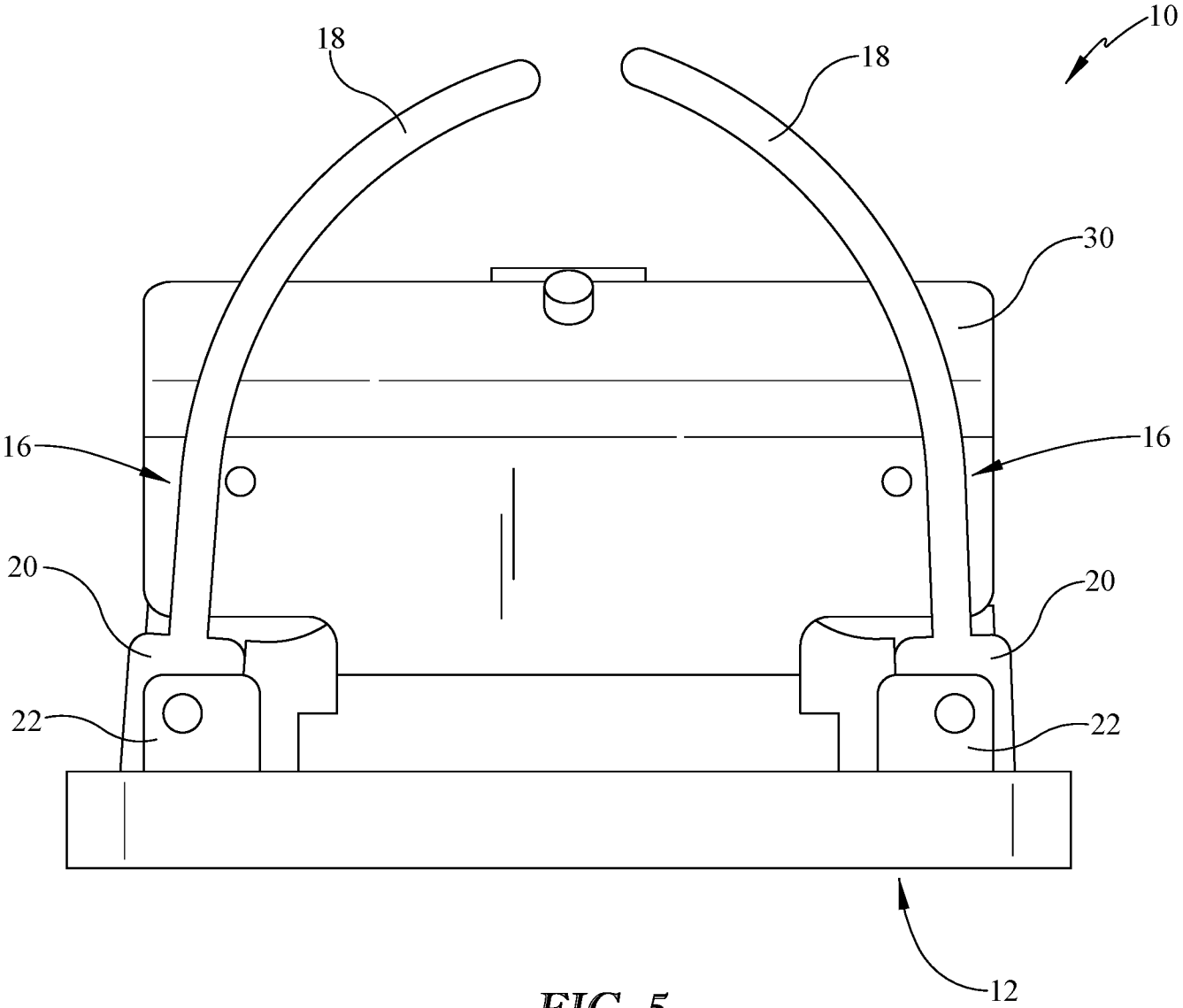
FIG. 5 is a first end view of the food cutting guide
Figure 6:
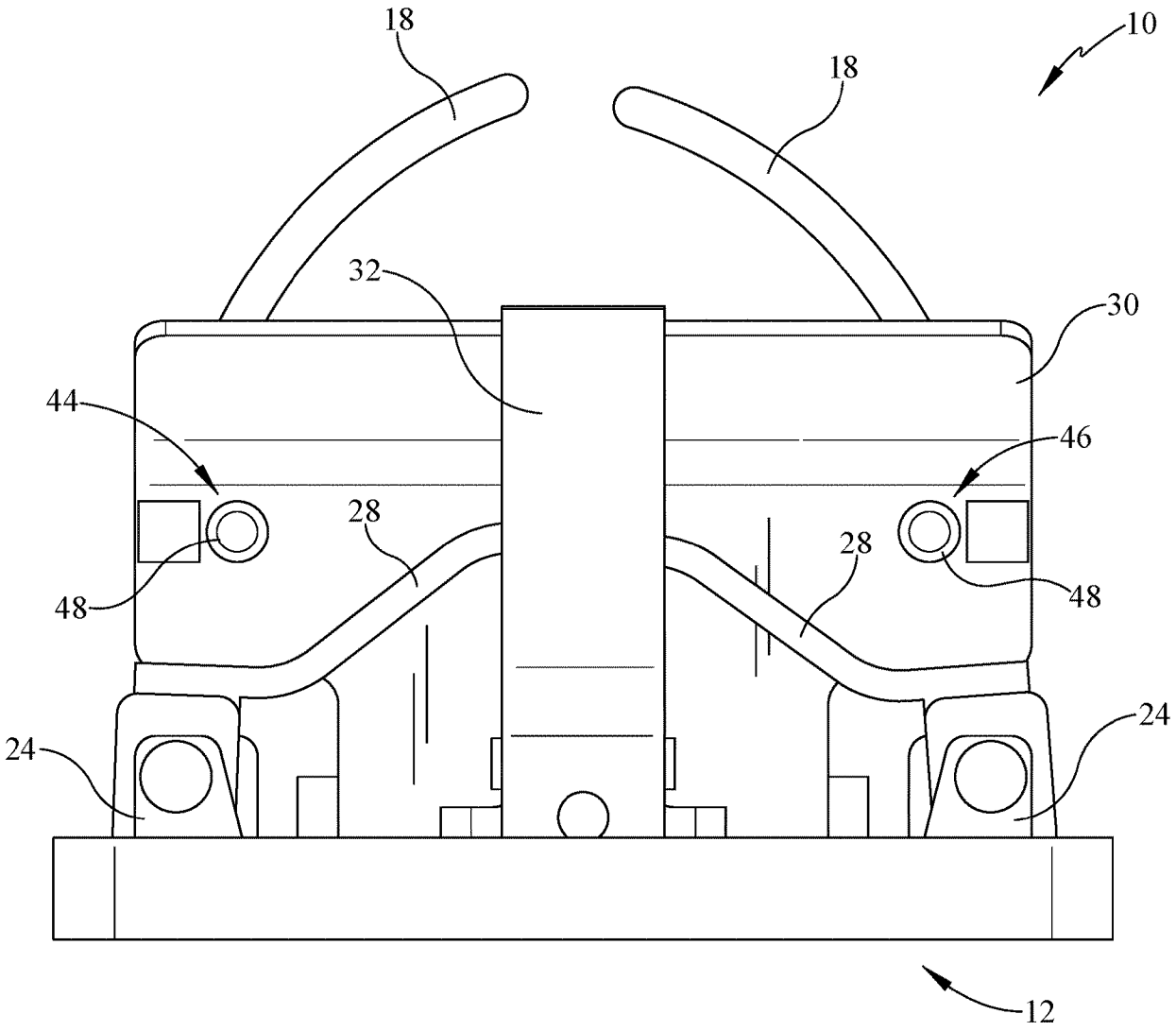
FIG. 6 is an opposing second end view of the food cutting guide.

Referring now to the drawings, it is seen that the food cutting guide of the present invention, generally denoted by reference numeral 10, is comprised of a base 12 of appropriate shape and size—the base may be the work surface upon which the food cutting guide 10 is stationed. The base 12 may have an upwardly directed annular flange 14 to help catch any juices or food product being cut from escaping from the base 12. The base 12 may be made from any appropriate material, such as plastic, stainless steel, silicone, wood, etc. A pair of opposing jaws 16 are pivotally attached to the base 12 and articulate between an closed, normally relaxed gripping position wherein the teeth 18 of the jaws 16 intermesh, as best seen in FIG. 1, and an open position wherein the teeth 18 of the jaws are spread apart from each other, as seen in FIGS. 2-6. Each jaw 16 is comprised of a jaw bar 20 that is axially attached to a first end post 22 located proximate an end of the base 12 and a second end post 24 located medially about the base 12. As seen, a jaw spring 26 has one end attached to the jaw base 20 of the jaw 16 and the opposing end attached to the second end post 24. The jaw spring 26 biases its jaw 16 into the normally relaxed closed position as seen in FIG. 1. The teeth 18 of the jaw 16 are located in spaced apart position along the jaw bar 20 and extend upwardly from the jaw bar 20 and curve toward the opposing jaw 16. As stated, the teeth 18 of each jaw 16 are positioned so that when the jaws 16 are articulated into the closed position, the teeth 18 of each jaw 16 intermesh with one another. The teeth 18 of each jaw 16, and possibly the entire jaw 16 are made from an appropriate food grade material such as stainless steel, plastic, silicone, etc.

An actuator bar 28 is attached to the top of the jaw bar 20 of each jaw 16 and extends toward the opposing jaw 16. As seen, each actuator bar 28 curves upwardly at its distal end.

A guard plate 30 is attached to the base via diagonal post 32 that extends from the ends of the jaws 16 toward one of the ends of the base 12, the distal end of the diagonal post 32 attached to the base 12 in appropriate fashion. A pair of support posts 34 is attached to the base 12 and to a medial portion of the diagonal post 30 such that a narrow gap 36 exists between the support posts 34.

An actuator trigger 38 has a first end 40 pivotally attached to the distal end of the diagonal bar 32. The actuator trigger 38 also has a proximal end 42 located underneath the pair of actuator bars 28. The actuator trigger 38 passes through the gap 36 between the pair of support posts 34.

A pair of stop pins 44 is located on the guard plate 30 passing therethrough. Each stop pin 44 can be pushed or depressed toward the jaws 16 such that when so pushed, an appropriate ball stop (not illustrated) locks the stop pin 44 in such depressed position, as best seen in the upper stop pin 44 in FIG. 4. When the stop pin 44 is pressed slightly in the depressed position, the ball stop releases and a spring 46 encircling the stop pin 44 and biased between the head 48 of the stop pin 44 and the guard plate 30 causes the stop pin 44 to spring bias back to its undepressed position.

In order to use the food cutting guide 10 of the present invention, with the jaws 16 of the device in the relaxed normally closed position, the jaws 16 are opened. This is accomplished by grasping the actuator trigger 38 and squeezing the actuator trigger 38 toward the diagonal post 32. The support posts 34 act as a guide for the actuator trigger 38. As the actuator trigger 38 pivots upwardly, its distal end 42 engages each of the actuator bars 28 and pushes each upwardly, the curved portion of each actuator bar 28 adding fluidity in this motion, resulting in a relatively smooth actuator trigger 38 pull. The upwardly travelling actuator bars 28, cause the jaw bar 20 to which the specific actuator bar 28 is attached to rotate away from the opposing jaw 16 against the spring mechanism of that jaw 16. This causes the teeth 18 of each jaw 16 to rotate away from one another and to unmesh. When the jaw 16 is in the open position, a desired food item is placed between the open jaws 16. Once the food item is positioned as desired, the actuator trigger 38 is released causing it to pivot downwardly so that its distal end 42 rests on the base 12. This causes the distal end 42 of the actuator trigger 38 to disengage from each of the actuator bars 28. As no force is being placed on the actuator bars 28, the jaw spring 26 of each jaw 16 biases its jaw 16 toward the other jaw 16 so that the teeth 18 of each jaw 16 once again intermesh, and the jaws 16 are in the closed position. The jaw spring 26 helps bias its jaw 16 into a gripping position onto the food item held between the jaws 16. If the user desired, one or both jaws 16 can be locked in this closed position by pressing the stop pin 44 associated with that jaw 16 inwardly toward that jaw 16. The stop pin 44 is dimensioned so that once it is pressed inwardly and is in the locked depressed position, the stop pin 44 interferes with the travel path of the endmost tooth 18 of that jaw 18 and thus prevents that tooth 18, and thus the entire jaw 16, from rotating into the open position. As the food item is being gripped by the teeth 18 of each jaw 16, the user is able to slice the food item as desired, with the evenly spaced teeth 18 of each jaw 16 providing a guide that allows for essentially uniform cuts through the food item. As the user is gripping the food cutting guide 10 via the diagonal post 32 in order to be able to actuate the actuator trigger 38, the guard plate 30 provides protection to the user's hand show an errant slice of the knife K occur.

Once the food items are sliced as desired, the jaws 16 are once again articulated into the open position and the slices of the food item are removed.

While the invention has been particularly shown and described with reference to an embodiment thereof, it will be appreciated by those skilled in the art that various changes in form and detail may be made without departing from the spirit and scope of the invention.

I claim:

1. A food cutting guide comprising:

a base;

a pair of opposing jaws, each jaw having a pair of spaced apart teeth, such that the jaws are rotatably attached to the base and articulate between a closed position wherein the teeth of one of the jaws intermesh with the teeth of the other jaw, and an open position wherein the teeth of each jaw are not intermeshed and are spaced apart from one another;

a spring mechanism attached to each jaw such that the spring mechanism spring biases each jaw into the closed position; and an actuator trigger pivotally attached to the base, such that the actuator trigger engages each jaw and moves the jaws into the open position, overcoming the spring bias of the spring mechanism.

2. The food cutting guide as in claim 1 further comprising a guard plate attached to the base and positioned at an end of the pair of jaws.

3. The food cutting guide as in claim 2 further comprising a stop pin attached to the guide plate and slidable between a stop position wherein the stop pin is within a travel path of one of the jaws and an unstop position wherein the stop pin is not in the travel path of the jaw.

4. The food cutting guide as in claim 3 wherein the stop pin is articulated between the stop and the unstop position via a spring encircling the stop pin.

5. The food cutting guide as in claim 1 wherein each jaw is comprised of a jaw bar that is axially attached to a pair of opposing posts such that the teeth of the jaw extend upwardly from the jaw bar.

6. The food cutting guide as in claim 1 further comprising a pair of actuator bars, one bar each attached to a respective one of the jaw bars such that when the actuator trigger is pivoted upwardly away from the base, the actuator trigger engages each actuator bar causing each jaw to rotate to the open position.

7. The food cutting guide as in claim 6 wherein each spring mechanism comprises a jaw spring having a first end attached to a respective one of the jaw bars and an opposing second end attached to one of the posts of that jaw bar.

8. The food cutting guide as in claim 6 wherein each spring mechanism comprises a jaw spring having a first end attached to a respective one of the jaw bars and an opposing second end attached to one of the posts of that jaw bar.

9. The food cutting guide as in claim 1 wherein each of the teeth of a jaw are curved toward the opposing jaw.

* * * * *